US007327829B2

(12) United States Patent
Chidester

(10) Patent No.: US 7,327,829 B2
(45) Date of Patent: Feb. 5, 2008

(54) CATHODE ASSEMBLY

(75) Inventor: Charles Lynn Chidester, West Bountiful, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/828,637

(22) Filed: Apr. 20, 2004

(65) Prior Publication Data

US 2005/0232396 A1 Oct. 20, 2005

(51) Int. Cl.
*H01J 35/06* (2006.01)

(52) U.S. Cl. ..... 378/136

(58) Field of Classification Search ..... 378/136; 313/271–273, 341, 344, 450, 454, 578, 579, 313/620, 631

See application file for complete search history.

(56) References Cited

U.S. PATENT DOCUMENTS 2,454,765 A * 11/1948 Braunsdorff ..... 362/296
2,479,193 A * 8/1949 Zabel ..... 313/343
3,846,006 A 11/1974 Atlee et al.
3,969,629 A 7/1976 McIntyre
4,072,865 A 2/1978 Craig et al.
4,114,987 A 9/1978 Vagi
4,144,457 A 3/1979 Albert
4,315,154 A * 2/1982 Weigl et al. ..... 378/115
4,775,992 A 10/1988 Resnick et al.
4,823,371 A 4/1989 Grady
4,866,749 A * 9/1989 Uematu ..... 378/134
4,894,853 A 1/1990 Dowd
4,924,485 A 5/1990 Hoeberling
4,959,585 A * 9/1990 Hoegler et al. ..... 313/271
5,077,773 A 12/1991 Sammon
5,170,422 A 12/1992 Fiebiger
5,418,833 A 5/1995 Logan
5,602,441 A 2/1997 Ohsako et al.
5,619,092 A 4/1997 Jaskie
5,623,530 A * 4/1997 Lu et al. ..... 378/136
5,625,661 A 4/1997 Oikawa
5,756,998 A * 5/1998 Marks et al. ..... 250/324
5,878,109 A 3/1999 Negle et al.
5,907,595 A * 5/1999 Sommerer ..... 378/136
6,018,566 A 1/2000 Eberhard et al.

(Continued)

FOREIGN PATENT DOCUMENTS

FR 2699326 A1 * 6/1994
JP 02239555 A * 9/1990

*Primary Examiner*—Courtney Thomas
(74) *Attorney, Agent, or Firm*—Workman Nydegger

(57) ABSTRACT

An improved cathode assembly, including a filament for producing an electron stream having a highly uniform cross sectional density. The cathode assembly comprises a support base, a cathode cup affixed to the support base, and a filament disposed in a slot defined on the bottom face of the cup. In one embodiment, the side walls of the slot are shaped so as to allow greater electric field penetration about regions of the filament that typically produce relatively low quantities of electrons, thereby increasing electron emission therefrom. Other embodiments are directed to modifying either the filament winding configuration or the wire from which the filament is formed, in order to equalize electron production by the filament. The uniformly dense electron stream is preferably directed toward the anode of an x-ray tube, thereby producing a superior x-ray beam for a variety of applications.

18 Claims, 8 Drawing Sheets

U.S. PATENT DOCUMENTS 6,059,627 A 5/2000 Dean et al.
6,259,193 B1 * 7/2001 Lipkin et al. ..... 313/341
6,333,969 B1 * 12/2001 Kujirai ..... 378/138
6,356,619 B1 * 3/2002 Nagy et al. ..... 378/138

* cited by examiner

CATHODE ASSEMBLY

CROSS-REFERENCE TO RELATED APPLICATIONS

Not applicable.

BACKGROUND OF THE INVENTION

1. The Field of the Invention

The present invention generally relates to electron emitting devices. More particularly, the present invention relates to a cathode assembly that includes features directed to facilitating modifications to the density of the electron stream emitted by the cathode assembly.

2. The Relevant Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, then impinged upon a material of a particular composition. This process typically takes place within an x-ray tube located in the x-ray generating device. The x-ray tube generally comprises a vacuum enclosure, a cathode, and an anode. The cathode generally comprises a metallic cathode head and a cathode cup disposed thereon. A rectangular slot formed in the cathode cup typically houses a filament that, when heated via an electrical current, emits a stream of electrons. The cathode is disposed within the vacuum enclosure, as is the anode, which is oriented to receive the electrons emitted by the cathode. The anode, which typically comprises a graphite substrate upon which is disposed a heavy metallic target surface, can be stationary within the vacuum enclosure, or can be rotatably supported by a rotor shaft and a rotor assembly. The rotary anode is typically spun using a stator that is circumferentially disposed about the rotor assembly, and is disposed outside of the vacuum enclosure. The vacuum enclosure may be composed of metal (such as copper), glass, ceramic material, or a combination thereof, and is typically disposed within an outer housing.

In operation, an electric current is supplied to the cathode filament, causing it to emit a stream of electrons by thermionic emission. A high electric potential placed between the cathode (negative) and anode (positive) causes the electrons in the electron stream to gain kinetic energy and accelerate toward the target surface located on the anode. The point at which the electrons strike the target surface is referred to as the focal spot. Upon striking the focal spot, many of the electrons lose their kinetic energy, which causes the electrons or the target surface material to emit electromagnetic radiation of very high frequency, i.e., x-rays. The specific frequency of the x-rays produced depends in large part on the type of material used to form the anode target surface. Target surface materials having high atomic numbers ("Z numbers"), such as tungsten carbide or TZM (an alloy of titanium, zirconium, and molybdenum) are typically employed. The target surface of the anode is angled with respect to the stream of electrons to minimize the size of the resultant x-ray beam, while maintaining a sufficiently sized focal spot. The x-ray beam produced by the target surface then passes through windows that are defined in the vacuum enclosure and outer housing. Finally, the x-ray beam is directed to the x-ray subject to be analyzed, such as a medical patient or a material sample.

As mentioned above, a typical cathode includes a cathode cup attached to a cathode head. A filament is disposed within a rectangular slot defined by the cathode cup. The filament typically comprises a wire made from tungsten or similar material that is uniformly wound about a mandrel to form a helix. The ends of the filament wire are electrically connected to leads disposed in the bottom of the cathode cup slot. In addition to housing the filament, the cathode cup also shapes the electrical field near the filament that is created by the high electric potential that exists between the cathode and the anode during tube operation. By shaping the electrical field, and thus affecting the strength of the electrical field between the cathode and anode, the cathode cup helps deflect electrons toward the focal spot on the anode target surface.

A recurrent challenge encountered in the operation of x-ray tubes concerns the uniformity of the electron stream emitted by the cathode, and the resultant uniformity of electron impacts upon the focal spot of the anode target surface. As mentioned earlier, electrons are produced during tube operation when a current is passed through the cathode filament, causing it to become heated. When the filament reaches a certain temperature, it begins to emit electrons by a process known as thermionic emission. During the thermionic emission process, however, a temperature gradient is established in the filament, wherein relatively higher temperatures are present in the middle region of the filament and relatively lower temperatures are present in the end regions of the filament. Because the rate at which electrons are produced by an electron-emitting medium is closely related to the temperature of the medium, the temperature gradient of the filament causes relatively more electrons to be produced by the middle region of the filament than by the end regions, thus creating an unevenly distributed cloud of electrons directly above the cathode.

The cloud of electrons described above generally resembles the shape of the filament. When considered from a viewpoint opposite the filament, the electron cloud appears relatively more populated with electrons near its middle region than near the ends of the cloud. The high electric potential present between the cathode and the anode causes the electrons in the electron cloud emitted by the cathode to accelerate toward the anode focal spot. During such acceleration, the electrons in the electron stream retain the uneven distribution described above. When the electron stream impacts the anode target surface, relatively more electron impacts occur on the area of anode focal spot corresponding to the middle region of the impacting electron stream than on the focal spot area corresponding to the ends of the stream. Undesirably, the uneven distribution of the impacting electrons results in an x-ray beam emitted by the x-ray tube having a similarly uneven distribution of x-rays across the beam when the electron beam is viewed in cross-section.

Unfortunately, such an x-ray beam produces images of relatively poor quality and detail. The performance of the x-ray tube is thus compromised, thereby necessitating the generation of additional x-ray images to compensate for the low quality images. The result is additional operating cost, waste of resources, and possible added risk to the human subject or operator of the x-ray generating device.

Some control over electron beam density may be achieved by way of an electron shield defining an aperture placed in the path of the uneven electron stream so as to selectively restrict the travel of portions of the unevenly distributed electron cloud. Such an approach is problematic for a variety of reasons however. First, the shield allows only a portion of the total number of electrons created by the filament to proceed to the focal spot, thus resulting in an inefficient use of x-ray tube power. Second, the surface of the shield alters the shaping of the electrical field near the cathode, which may undesirably affect electron acceleration toward the focal spot. Third, in order to stop the undesired electrons, the shield must dissipate their kinetic energy, which causes undesirable heating within the x-ray tube. Thus, additional heat removing structures or systems must be employed to compensate for the additional heating caused by the shield, which undesirably add to the cost and complexity of the tube.

A need therefore exists for a cathode assembly that includes features which permit adjustments to the density of the emitted electron beam. When disposed in an x-ray tube, the cathode should enable, among other things, production of x-ray beams having a substantially uniform cross-sectional density, thus permitting generation of higher quality images. Desirably, this need would be met without creating undesirable side effects, such as excessive tube heating.

BRIEF SUMMARY OF THE INVENTION

In accordance with the invention as embodied and broadly described herein, the foregoing and other needs are met by an improved cathode assembly. Embodiments of the present invention are directed to a cathode assembly for producing an electron stream having a desired cross-sectional electron density.

In the various embodiments disclosed herein, the cross sectional density of the electron stream is optimized by physically modifying the electron-emitting filament of the cathode and/or the cathode cup in which the filament is disposed. The physical modifications are preferably made with respect to a longitudinal axis defined by the filament. In one embodiment, a slot in the cathode cup, in which the filament is disposed, has vertical walls whose distance from the filament varies as a function of position on the longitudinal axis defined by the filament. The vertical walls may, for example, define an arcuate shape such that the respective end portions of each vertical wall are disposed a relatively greater distance away from the filament than are the respective middle portions of such vertical walls. Such a configuration allows the high potential electric field existing between the cathode and the anode to penetrate the areas near the ends of the filament to relatively greater extent than the region near the middle of the filament. Because the ends of the filament typically produce fewer electrons than the middle portion of the filament, the relatively greater electric field penetration near the end portions of the filament made possible by the shaped walls allows a greater percentage of electrons produced by the filament end portions to be accelerated toward the anode. This results in an electron stream having relatively more uniform electron density profile which implicates a relatively more uniform x-ray density in the x-ray beam produced by the electron-emitting device.

In an alternative embodiment of the present invention, emphasis is placed on modifying geometric aspects of the filament, such as the pitch, or turns per unit length, of the helical filament. Preferably, the pitch of the filament is greater at the end portions than at the middle portion of the filament. The relatively higher pitch at the end portions equates to more turns per unit length of the filament and thus, relatively greater filament surface area at the end portions. Because the production of electrons by a filament is closely related to the surface area of the filament, the end portions in this alternative embodiment produce relatively more electrons than those that would be produced by filament end portions having a relatively smaller pitch. The enhanced electron production of the higher-pitched end portions characteristic of this embodiment, then, counteracts the relatively high electron emission in the middle portion of the filament due to the increased temperature typically present in the middle region. Thus, the emission of electrons by the middle portion and the end portions of the filament is relatively more balanced, resulting in an electron stream having a substantially uniform cross sectional density.

In another embodiment, the diameter of the turns of the helical winding is varied as a function of position along the axis defined by the filament. Preferably, the diameter of each turn of the helical filament decreases as a function of longitudinal distance from center of the filament such that turn diameter is greatest in the middle portion of the filament, and least near the ends. The middle portion of the filament is thus disposed nearer the slot walls of the cathode cup than are the end portions of the filament. Consequently, the electric field of the device is able to penetrate the area surrounding the ends of the filament to a relatively greater degree than the area surrounding the middle portion. The relatively greater penetration of the electric field compensates for the typically higher emission of electrons from the middle portion of the filament by enabling a greater acceleration of electrons produced from the ends of the filament toward the focal spot. In this way, a more uniform electron stream is produced.

In yet another embodiment, the wire from which the helical filament is formed is varied in its diameter such that the wire diameter is smaller at the ends than at the middle portion. When formed as a helical filament then, relatively less heating occurs in the middle portion of the filament because of the relatively larger diameter of the wire in this region, while relatively greater heating occurs in the end portions of the filament. The relative temperature disparity produced by this geometry helps counteract the added electron-producing surface area naturally present at the middle portion of the filament due to the thicker wire, which results in a substantially uniform electron density in the electron beam emitted by the cathode.

In another embodiment, a combination of one or more features of the previously discussed exemplary embodiments can be utilized to create a substantially uniform cross-sectional density in the electron stream emitted by the cathode assembly. Further, various combinations of the features of the foregoing exemplary embodiments can be employed to create an electron stream having a cross sectional electron density that is not uniform, but rather varies according to the requirements of a particular application.

These and other features of the present invention will become more fully apparent from the following description and appended claims.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale. FIGS. 1-9 depict several embodiments of the present invention, which is directed to an improved cathode assembly for emitting an electron stream having a desired electron density profile. Alternatively, the present cathode assembly may be configured such that an electron stream emitted by the cathodes is modified as desired for a particular application.

Figure 1:
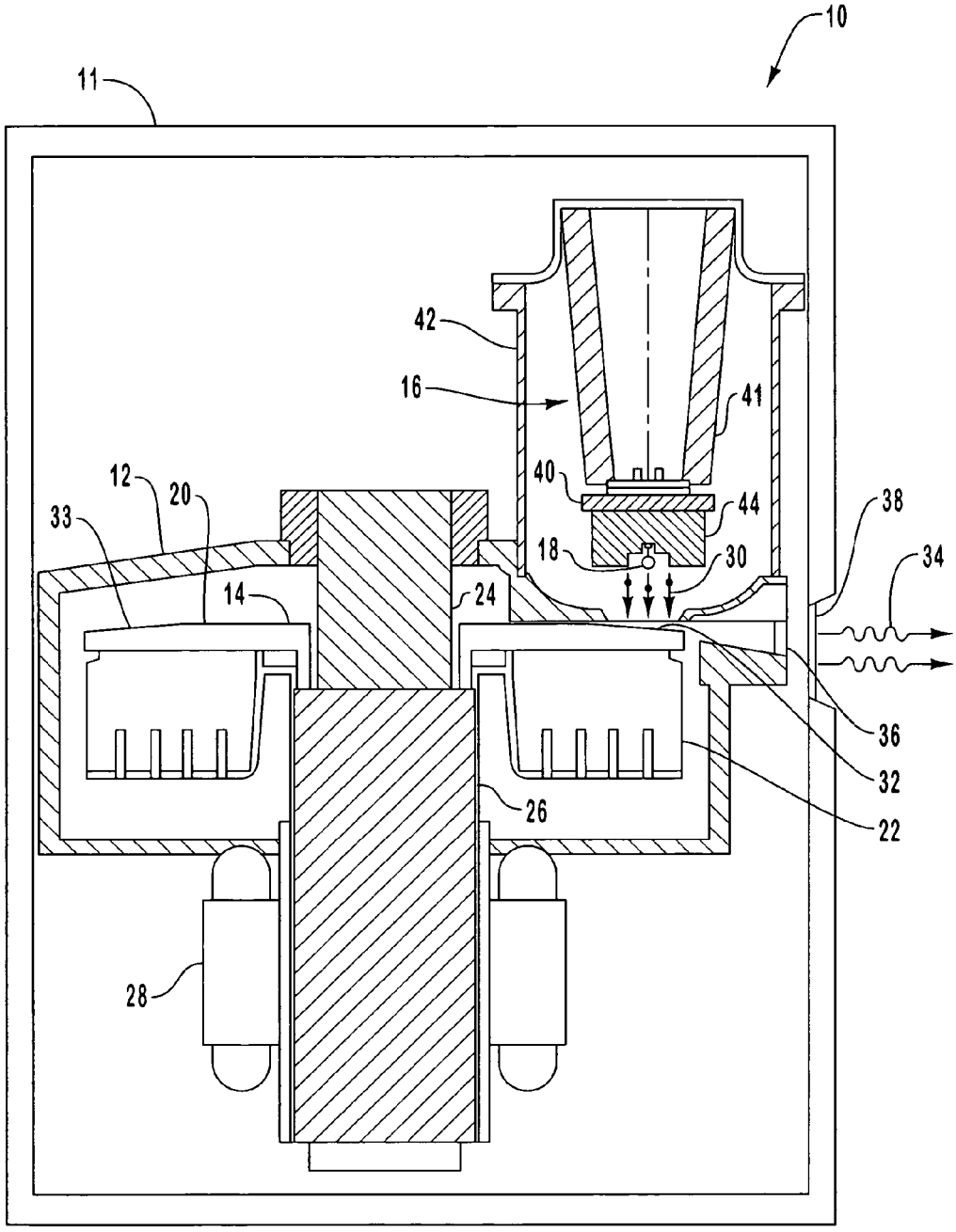
FIG. 1 is a simplified cross sectional side view of an x-ray tube within which is disposed an embodiment of a cathode assembly.

Reference is first made to FIG. 1, which depicts an x-ray tube 10. The x-ray tube 10 includes an outer housing 11 and a vacuum enclosure 12 disposed within the outer housing 11. A rotary anode 14 and a cathode assembly 16 are disposed inside the vacuum enclosure 12. The anode 14 is spaced apart from, and oppositely disposed with respect to, the cathode assembly 16 in such a way as to be positioned to receive electrons emitted by a filament 18 of the cathode assembly 16. A target surface 20 is disposed on a substrate 22 of the anode 14. The anode 14 is rotatably supported by a support stem 24 and a bearing assembly 26 such that the anode is able to rotate at a high rate of revolution, under the influence stator 28, during tube operation. Because the anode 14 supporting the target surface 20 rotates during tube operation, a focal spot 32 is occupied by successive portions of the target surface 20. These portions are collectively referred to as the focal track 33.

In order to produce x-rays, the filament 18 of the cathode assembly 16 is first connected to an electrical power source (not shown). Then, an electric field is created between the anode 14 and the cathode assembly 16 by applying a high positive voltage potential to the anode 14 and a high negative voltage potential to the cathode assembly 16. The electrical current passing through the filament 18 causes a cloud of electrons, designated at 30, to be emitted from the cathode assembly 16 by thermionic emission. The electric field between the anode 14 and the cathode assembly 16 causes the electron stream 30 to accelerate from the cathode toward the focal spot 32 on the rotating target surface 20. As the electrons 30 accelerate, they gain a substantial amount of kinetic energy. Upon impacting the focal spot 32 of the anode target surface 20, many of the electrons 30 convert their kinetic energy into electromagnetic waves of very high frequency, i.e., x-rays.

The resulting x-rays, designated at 34, emanate from the anode target surface 20 and are then collimated first through a window 36 disposed in the vacuum enclosure 12, then through a window 38 disposed in the outer housing 11. The collimated x-rays 34 are directed for penetration into an object. The x-rays 34 that pass through the object can be detected, analyzed, and used in any one of a number of applications, such as x-ray medical diagnostic examination or materials analysis procedures.

Figure 2A:
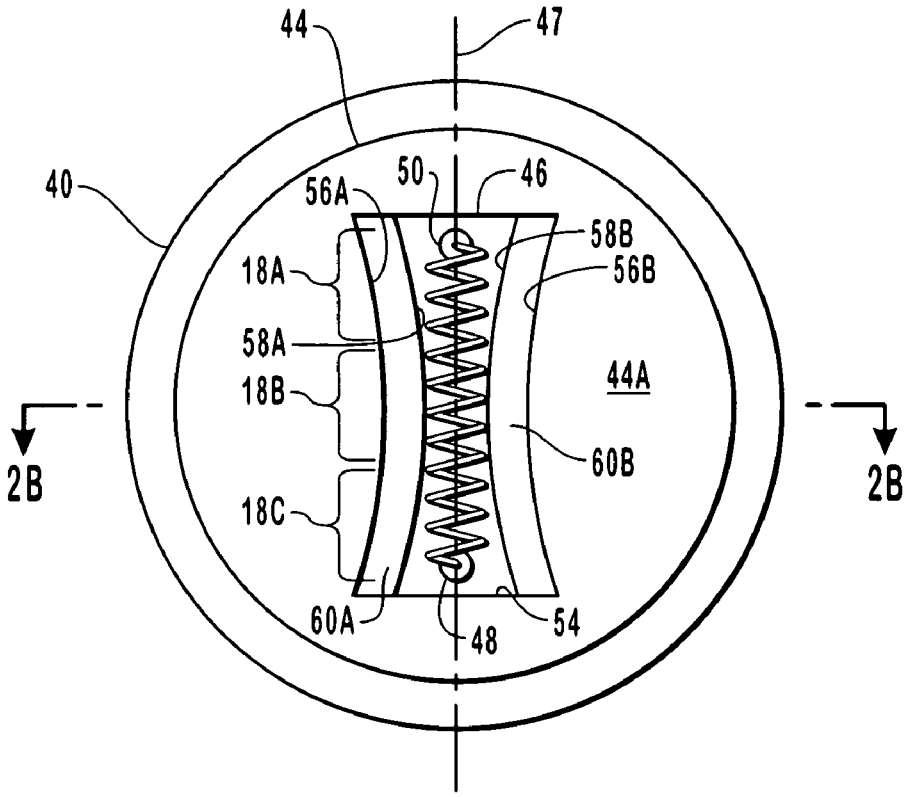
FIG. 2A is a bottom view of the cathode assembly of FIG. 1 depicting various features of one embodiment of the present invention.
Figure 2B:
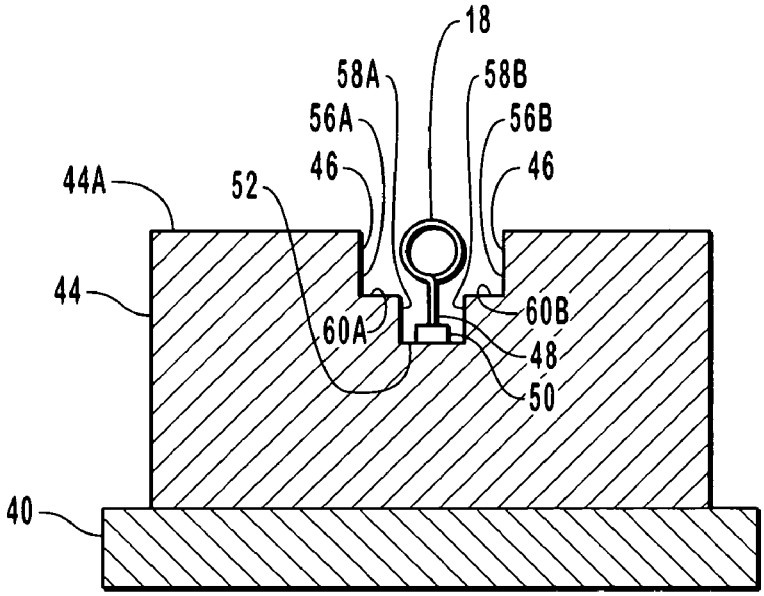
FIG. 2B is a cross sectional side view of the cathode assembly of FIG. A, taken along the line 2B-2B.

Reference is now made to FIGS. 2A and 2B, which depict a bottom view and a cross sectional side view, respectively, of a an embodiment of the cathode assembly 16. It is noted here that words such as bottom, top, above, and below are merely descriptive terms used to enable a sufficient description to be made. Accordingly, such words should not be construed to limit the scope of the present invention in any way.

As mentioned above, the cathode assembly 16 enables, among other things, the production of a uniform or patterned electron stream by the cathode filament. The cathode assembly 16 generally comprises a support base 40, a cathode cup 44, a slot 46 and the filament 18. The support base 40 is attached to a support cone 41 (see FIG. 1), and may serve as a platform upon which other components are mounted. The support cone 41, the support base 40, and the other components of the cathode assembly 16 are preferably disposed in a cathode housing 42 (see FIG. 1) that forms part of the vacuum enclosure 12. The cathode cup 44 is attached to the support base 40 and comprises a substantially planar bottom face 44A that is disposed opposite the anode target surface 20.

The cathode cup 44 preferably comprises a solid cylindrical portion, and may be composed of nickel, molybdenum, iron alloys, or similar materials. A slot 46 is defined in the cathode cup 44 for housing the filament 18 such that the longitudinal axis 47 defined by the filament 18 preferably extends substantially parallel to the bottom face 44A of the cathode cup 44. Variables such as the shape, width and depth of the slot 46 may be varied as necessary to suit the requirements of a particular application. In this embodiment, the filament 18 is preferably composed of a tungsten wire that is wound in the form of a helix comprising a first end portion 18A, a middle portion 18B and a second end portion 18C. An electrical lead 48 extends from each end portion 18A and 18C. Each of the two electrical leads 48 is electrically connected to a respective dielectric support post 50 disposed on a bottom surface 52 of the slot 46.

In addition to the bottom surface 52, the slot 46 is further defined by end walls upper side walls 56A and 56B, and lower side walls 58A and 58B. In this embodiment, the upper side walls 56A and 56B are disposed opposite to one another and extend from the bottom face 44A of the cathode cup 44 to the first and second ledges 60A and 60B, respectively. The ledges 60A and 60B are preferably perpendicularly disposed with respect to the side walls 56A and 56B. Similarly, the lower side walls 58A and 58B are disposed opposite one another and extend from the first and second ledges 60A and 60B, respectively, to the bottom surface 52 of the slot 46. In comparison to the upper side walls 56A and 56B, the lower side walls 58A and 58B are relatively more closely spaced to one another than are the upper side walls 56A and 56B.

Preferably, the side walls 56A, 56B, 58A and 58B of the slot 46 are shaped such that they are concavely arcuate with respect to one another. The aforementioned arrangement creates a spacing between the filament 18 and the upper and lower walls 56A, 56B, 58A, and 58B that varies along longitudinal axis 47. In other words, a greater spacing exists between the filament 18 and the wall 56A, for instance, at either the first or second filament end portion 18A or 18C, than exists near the middle filament portion 18B, as explained immediately below. The varied wall-to-filament spacing created by the arcuate wall shape enables electrons emitted by the filament 18 to be accelerated toward the focal spot 32 in a desired manner.

During tube operation, the filament 18 is energized by an electric current directed through the electrical leads 48. The electric current heats the filament 18 to the point where the filament 18 begins to emit the electrons 30 through thermionic emission. The emitted electrons 30 may be thought of as forming an electron cloud about the filament 18. Because of the characteristics of the current flow through the filament 18, uneven heating occurs therein, with relatively more heat being produced at the surface of the middle portion 18B of the filament than at the surface of the end portions 18A, 18C. The relatively greater heating at the middle portion 18B, with respect to the end portions 18A and 18C, causes more electrons to be emitted from the middle portion 18B, which causes the region of the cloud of electrons 30 surrounding the middle portion 18B to be populated with a higher density of electrons than the cloud regions surrounding the end portions 18A and 18C. The distribution of electrons with respect to a cross-section of the electron beam is referred to as the electron density profile. Because of the electrical field created by the high potential existing between the cathode assembly 16 and the anode 14, the electrons 30 in the electron cloud are accelerated in a stream toward the focal spot 32.

The natural tendency of the filament 18 is to produce an electron stream of uneven density. As explained above, this natural tendency results in an x-ray beam 34 of non-uniform electron density. However, the filament and slot wall configuration of this embodiment compensates for this non-uniform electron emission, and thereby creates an electron stream having a uniform cross sectional density upon emission from the cathode assembly 16.

In particular, because of the shape of the upper and lower side walls 56A, 56B, 58A, and 58B, a greater gap is defined between the filament end portions 18A and 18C, and the side walls than is defined at the middle filament portion 18B, as previously described. The penetration of the electrical field created by the high potential between the cathode assembly 16 and the anode 14 in the region surrounding the filament 18 is limited and shaped by the surfaces of the cathode cup 44, specifically the bottom face 44A thereof, and the side walls 56A, 56B, 58A, and 58B of the slot 46. The relatively wider gaps between the ends of side walls 56A, 56B, 58A and 58B and the filament end portions 18A and 18C allow the electrical field to penetrate the region of the slot 46 to a greater extent at the end portions 18A and 18C than at the middle portion 18B. This results in a greater electrical field strength about the end portions 18A, 18C of the filament. The greater electrical field strength concentration in turn imparts a relatively greater motive force on the electrons 30 in the region of the electron cloud surrounding the end portions of the filament than in the middle region of the cloud, thereby accelerating relatively more electrons from the end regions of the cloud.

Correspondingly, because a relatively smaller gap exists between the middle portion 18B and the side walls 56A, 56B, 58A, and 58B, less electric field is able to penetrate therein relative the gaps near the end portions 18A and 18C. Therefore, a motive force of relatively lower magnitude is imparted to electrons in the region of the electron cloud surrounding the middle portion 18B.

Because of the uneven electric field penetration into the slot 46 created by the arcuately shaped side walls 56A, 56B, 58A, and 58B, and the resulting non-uniform motive force magnitude, a greater percentage of the electrons 30 produced by the end portions 18A and 18C is accelerated toward the focal spot 32, relative to the percentage accelerated from the middle portion 18B. This imbalance in the number of accelerated electrons compensates for the greater total number of electrons 30 produced at the middle portion 18B as a result of the relatively higher surface heating in the middle portion. Thus, the relatively larger number of electrons emitted by the middle filament portion 18B is counteracted by the relatively greater number of electrons from the filament end portions 18A and 18C. Consequently, a stream of electrons 30 is produced that has a substantially uniform cross-sectional density.

Figure 3:
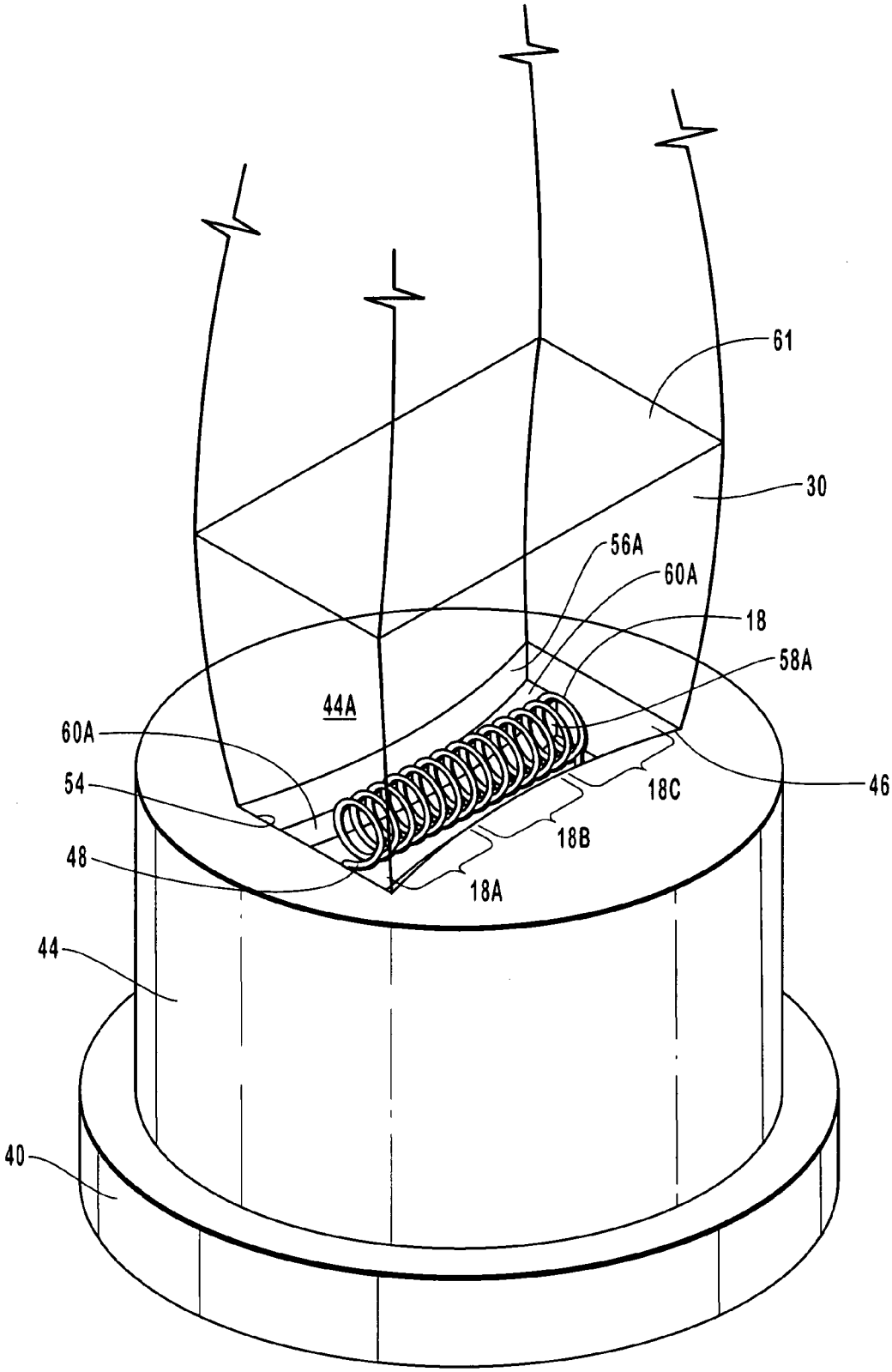
FIG. 3 is a perspective view of the cathode assembly of FIG. 2A, depicting various aspects of the operation thereof.

Such a uniformly dense electron stream is depicted in FIG. 3, which shows part of the cathode assembly 16 as well as a portion of the region in which the stream of electrons 30 is accelerated by the electric field toward the anode 14 (not shown). An imaginary plane 61 is arranged perpendicular to the direction of travel of the electrons 30. As a result of the geometry of cathode cup 44 the number of electrons 30 passing through a unit area of the imaginary plane 61 during tube operation is substantially equal over the entire surface of the imaginary plane 61. Consequently, the x-ray tube 10 emits an x-ray beam 34 possessing a substantially uniform cross sectional x-ray density, where x-ray density is understood to equal the number of x-rays per unit area of a cross section of the x-ray beam. As discussed above, improvements in the uniformity of a cross-sectional x-ray density may significantly enhance the quality of results obtained with the x-ray tube 10.

Figure 4A:
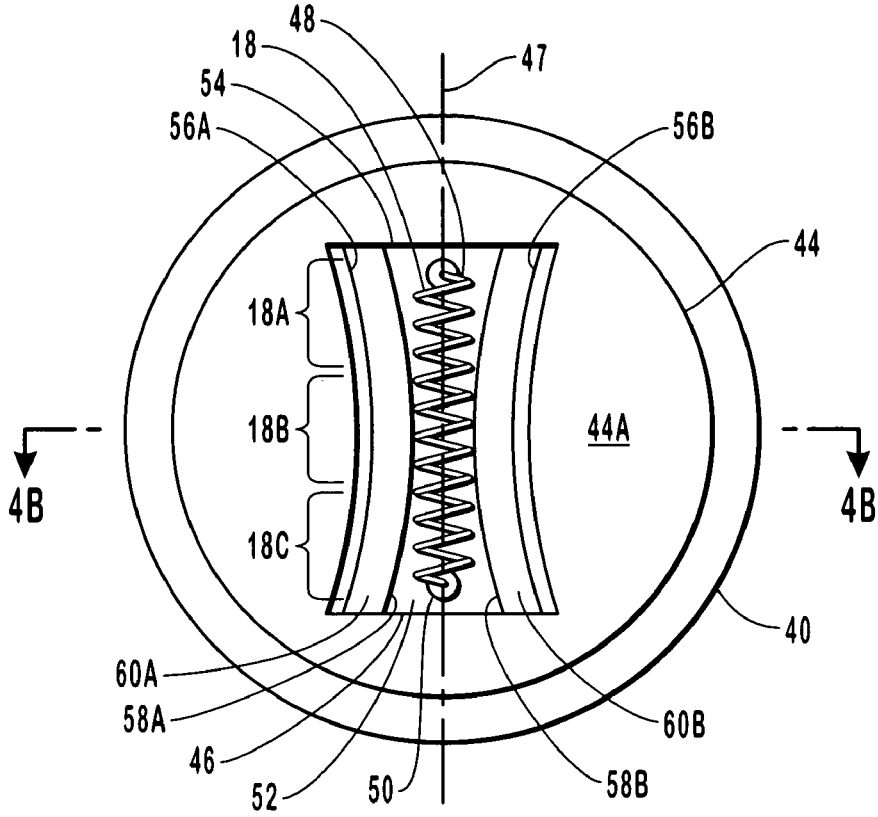
FIG. 4A is a bottom view of a cathode assembly depicting various features of another embodiment of the present invention.
Figure 4B:
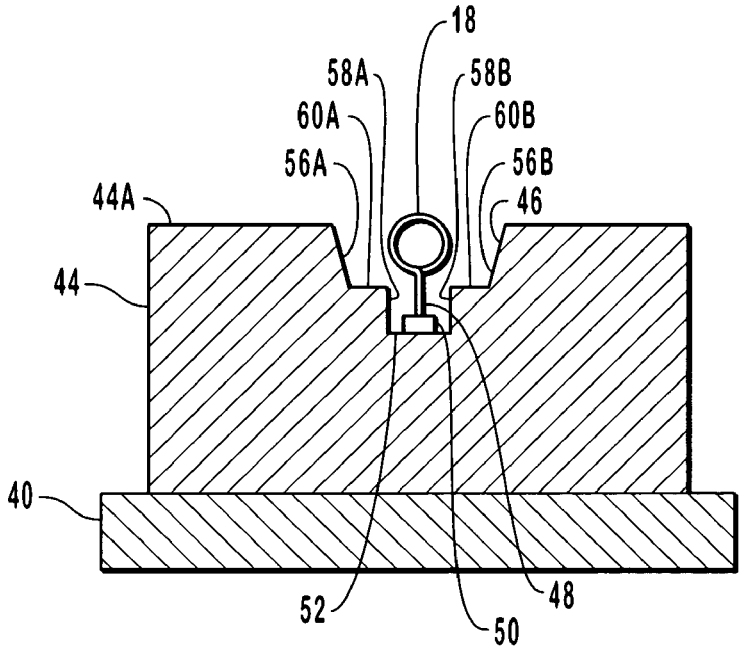
FIG. 4B is a cross sectional view of the cathode assembly of FIG. 4A, taken along the line 4B-4B.

The geometry of cathode cup 44 may be configured in other ways to produce various effects. This concept is illustrated in FIGS. 4A and 4B, which depict a side wall configuration for the slot 46 in accordance with an alternative embodiment of the cathode assembly 16. As can be seen in FIGS. 4A and 4B, the side walls 56A and 56B, though still retaining an arcuately concave shape, are now inwardly sloped from the bottom face 44A of the cathode cup toward the first and second ledges 60A and 60B, respectively. Such wall shapes may be utilized to modify the strength of the electrical field in the vicinity of the filament 18 consistent with a particular application. Such shaping of the electrical field may be desirable, for example, in order to focus the electron stream to create a particularly shaped focal spot 32.

Further, the configuration of upper walls 56A and 56B need not be smooth and continuous, nor is it necessary that the several side walls comprise similarly shaped surfaces. That is, the shaping of the aforementioned walls may vary independently of one another according to the desired functionality and shape of the electron stream emitted by the cathode assembly 16. Accordingly, the geometry of the cathode cup 44 may be configured as required to suit one or more particular applications. The embodiments illustrated herein, therefore, are exemplary only, and are not intended to limit the scope of the present invention in any way.

FIGS. 5A-9 depict various alternative embodiments of the cathode assembly 16 as described below. To the extent such embodiments include aspects or features common to embodiments previously described herein, no further discussion of such features and aspects will be provided. Rather, only selected differences between the various embodiments will be discussed below.

Figure 5A:
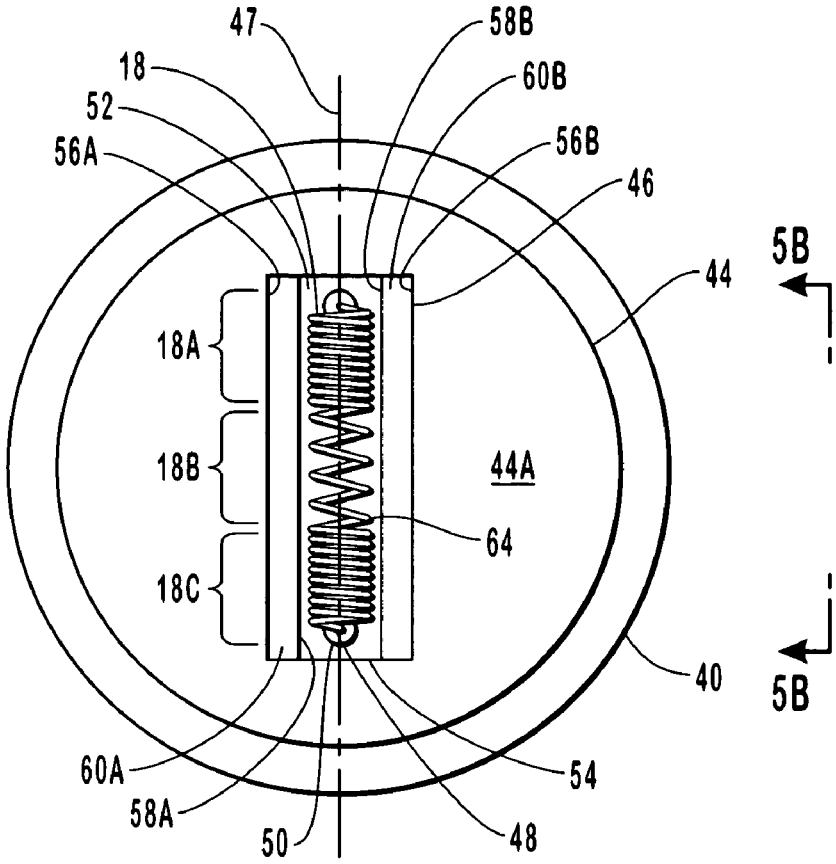
FIG. 5A is a bottom view of a cathode assembly depicting various features of yet another embodiment of the present invention.
Figure 5B:
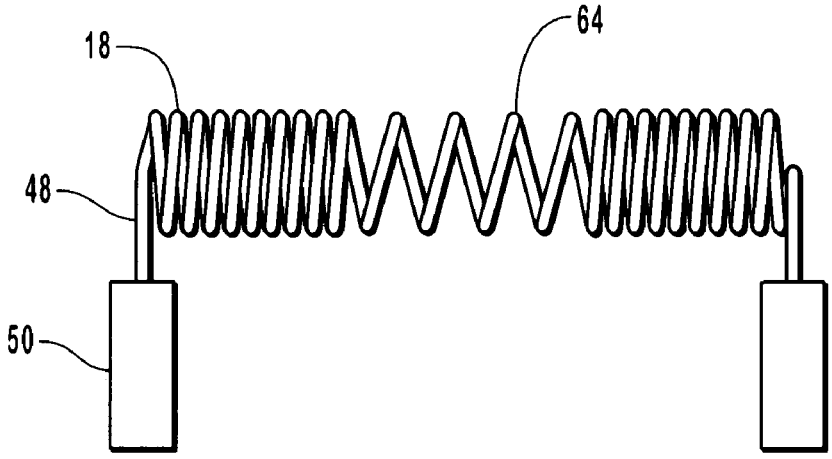
FIG. 5B is a front view of the filament of the cathode assembly of FIG. 5A.

Reference is now made to FIGS. 5A and 5B which depict two views of portions of the cathode assembly 16 in accordance with an alternative embodiment. The embodiment illustrated in FIGS. 5A and 5B portrays another configuration by which the cross sectional electron density of the stream of electrons 30 may be modified. The slot 46 of the cathode assembly 16 in which the filament 18 is disposed preferably comprises upper side walls 56A and 56B, and lower side walls 58A and 58B, as well as end walls 54 and a bottom surface 52. The upper side walls 56A and 56B are planar and are disposed opposite and parallel to one another, as are the lower side walls 58A and 58B. Walls 56A, 56B, 58A and 58B are perpendicular to both the bottom surface 52 of the slot 46 and to the bottom face 44A of the cathode cup 44.

Dielectric support posts 50 are disposed in the bottom surface 52 to electrically receive the electrical leads 48 of the filament 18. The filament 18 comprises the shape of a helix, defining a plurality of coils 64, each coil 64 comprising a complete loop of the wire from which the filament 18 is formed. The pitch, or number of coils 64 per unit length of the filament 18 varies as a function of the coil 64 position along the longitudinal axis 47 defined by the filament 18. Preferably, the pitch of the coils 64 is relatively higher in the middle portion 18B of the filament 18, which equates to fewer coils per unit length, than in the end portions 18A, 18C.

By winding the helical filament 18 as described immediately above, an electron stream of substantially uniform density may be achieved. Because the pitch of the middle portion 18B is relatively greater than at the end portions 18A and 18C, fewer coils 64 are defined in the middle portion of the filament. Consequently, there is relatively less wire surface area disposed in the middle portion 18B of the filament. In contrast, the filament end portions 18A and 18C possess a relatively lower pitch, meaning that relatively more coils 64 are disposed in the regions corresponding to the filament end portions. This equates to relatively more wire surface area in the end portions 18A and 18C of the filament. Therefore, despite the fact that wire near the middle portion 18B of the filament 18 emits more electrons per unit of surface area in comparison to the wire in the end portions 18A and 18C of the filament, the end portions 18A and 18C of the filament 18 are characterized by a relatively greater amount of wire, and thus more electron-emitting surface area. These factors cooperate to facilitate production of an electron stream of substantially uniform density along axis 47.

Figure 6A:
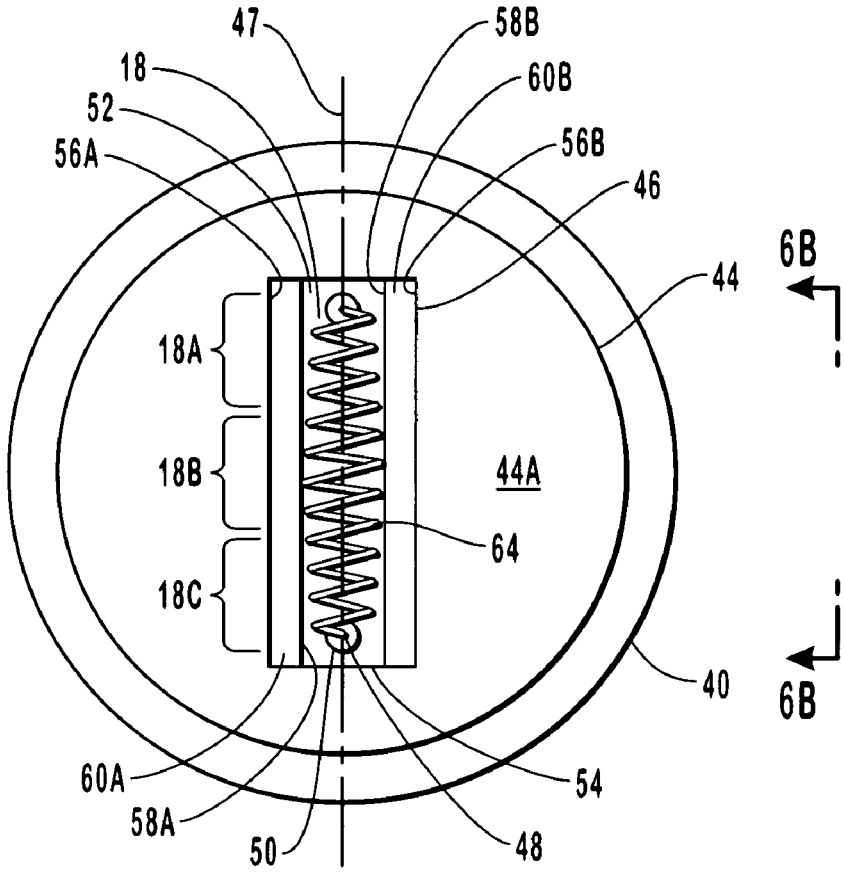
FIG. 6A is a bottom view of a cathode assembly depicting selected features of still another embodiment of the present invention.
Figure 6B:
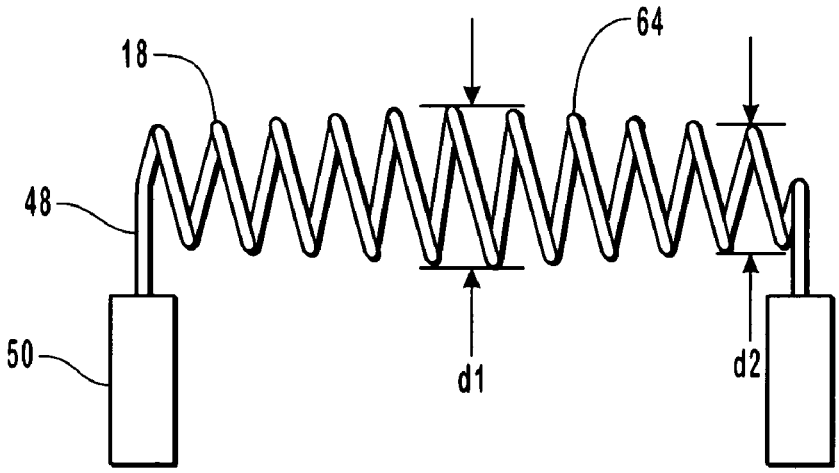
FIG. 6B is a side view of the filament of the cathode assembly of FIG. 6A.

FIGS. 6A and 6B depict two views of portions of the cathode assembly 16 in accordance with another embodiment of the present invention. This embodiment describes yet another configuration by which uniformity of the cross-sectional density of the electron stream may be achieved. In the illustrated embodiment, the pitch of the filament wire along the longitudinal length of the filament 18 is not varied, but rather the diameter of the helical winding is modified. As can be seen in FIGS. 6A and 6B, the winding diameter of the filament 18 is relatively larger at the middle portion 18A, corresponding to a diameter d1, than at the end portions 18A and 18C, where the winding diameter is relatively smaller, corresponding to a diameter d2. With such a winding, the distance between the filament 18 and the side walls 56A and 56B varies as a function of the position along the longitudinal axis 47 defined by the filament 18.

In a manner similar to the first embodiment described above, the relatively greater distance between the filament end portions 18A and 18C and the side walls 56A and 56B of the slot 46, as compared with the distance between the middle portion 18B and the side walls 56A and 56B, enables greater penetration of the filament end portions 18A and 18C by the electrical field. The relatively greater strength of the electrical field in these regions allows for a greater percentage of emitted electrons to be accelerated from the end portions 18A and 18C relative to the middle portion 18B, where the electric field is weaker due to the smaller distance between the filament 18 and the side walls 56A and 56B. In this way, the natural tendency of the filament 18 to emit more electrons from the middle portion 18B is counterbalanced by the greater electric field strength established at the end portions 18A and 18C of the filament 18, and an electron beam of substantially uniform electron density is directed onto the focal spot 32 (not shown).

It should be noted that the filament 18 and/or cathode slot configurations depicted in the accompanying figures are intended as exemplary, non-limiting embodiments of the cathode assembly 16, and various other configurations could be employed. For example, a variety of other pitch and/or winding diameter configurations could be devised to implement the functionality disclosed herein.

Figure 7A:
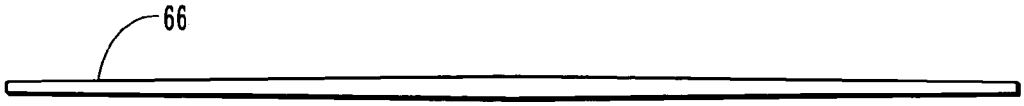
FIG. 7A is a side view of a wire from which one embodiment of a filament is made.
Figure 7B:
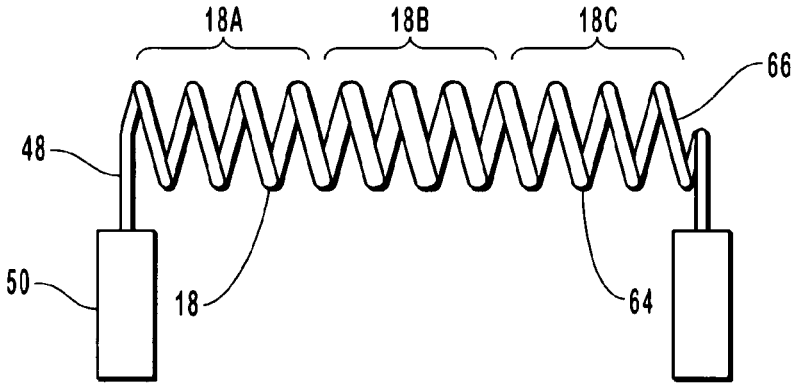
FIG. 7B is a side view of a filament made from the wire depicted in FIG. 7A.

Attention is now directed to FIGS. 7A and 7B which depict yet another embodiment of the cathode assembly 16. The filament 18 illustrated in FIGS. 7A and 7B is also intended to contribute to the generation of a uniformly dense electron stream 30. In general, FIG. 7A illustrates a strand of wire 66 from which is to be formed the helical filament 18. As can be seen in FIG. 7A the wire 66, whose dimensions have been exaggerated for the sake of clarity, has a diameter that is relatively large near the middle and progressively smaller toward the ends. When wound into the shape of a helix the resulting filament 18, illustrated in FIG. 7B, preferably comprises a middle portion 18B having coils 64 of a relatively greater wire thickness than the wire forming the coils found in the end portions 18A and 18C.

Because of the relatively greater surface area of the thicker wire in middle portion 18B, the middle portion 18B does not reach as high a surface temperature, for a given level of electric current, as the end portions 18A and 18C. This temperature differential results in a reduction in the emission of electrons due to thermionic emission from the middle portion 18B. Consequently, a relatively more uniform electron emission profile is achieved along the entire length of the filament 18, thereby leading to higher quality x-ray output from the x-ray tube 10.

If desired, the wire 66 could be formed to have a middle portion that is thinner than the end portions. Alternatively, the wire 66 could comprise several regions having distinct diameters. Again, various wire geometries could be employed to achieve an electron stream of desired cross-sectional density.

Figure 8:
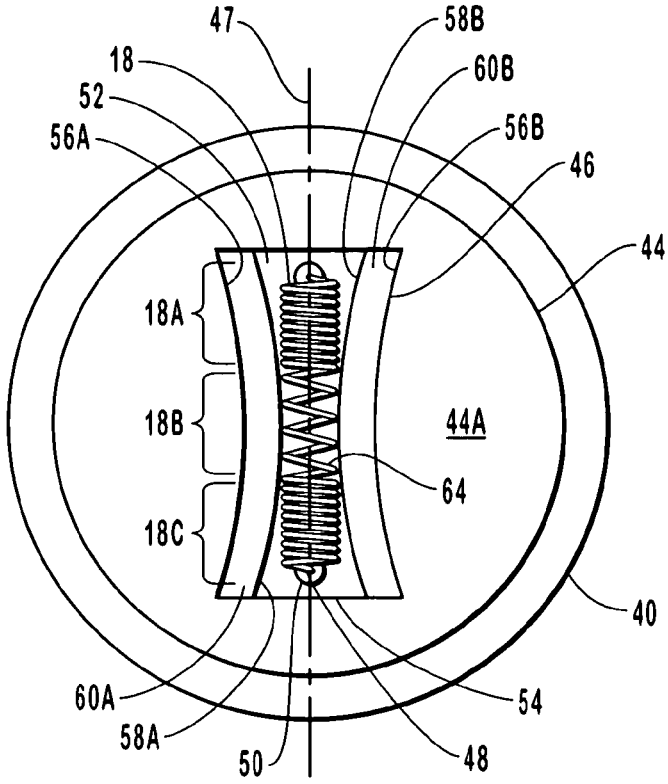
FIG. 8 is a bottom view of a cathode assembly depicting selected features of an alternative embodiment of the present invention.

Reference is now made to FIG. 8 which illustrates various features of another alternative embodiment of the cathode assembly 16. The features detailed in the various embodiments described herein may be combined as desired to achieve a particular effect. For example, as shown in FIG. 8, the slot 46, having arcuately concave walls 56A, 56B, 58A, and 58B, could be combined with the filament 18 having coils 64 of a varying pitch as described in another of the embodiments. This combination might be desirable, for example, to enhance the emission of electrons 30 from the end portions 18A and 18C to a greater extent than would otherwise be the case.

Figure 9:
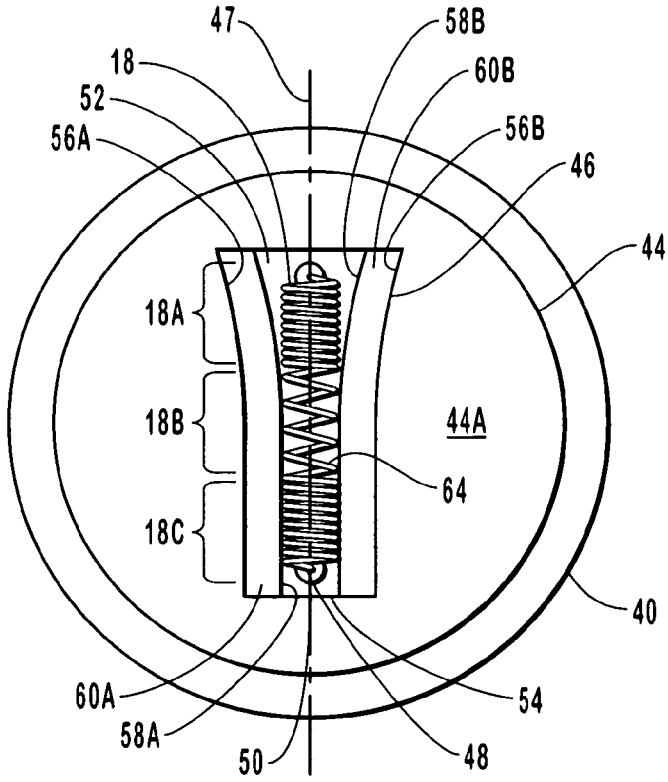
FIG. 9 is a bottom view of a cathode assembly depicting selected features of another alternative embodiment of the present invention.

Alternatively, the cathode assembly 16 may be configured so as to produce an electron stream having a desired, but not necessarily uniform, cross-sectional density. An example of such a cathode assembly 16 is depicted in FIG. 9, which shows an alternative embodiment of the cathode assembly 16 comprising a cathode cup 44 having defined on the bottom face 44A thereof a slot 46. The slot 46 comprises upper side walls 56A and 56B, and lower side walls 58A and 58B as in previous embodiments. Only a portion of the side walls 56A, 56B, 58A, and 58B, however, define an arcuate shape as previously described in another embodiment. The remaining portions of the upper side walls 56A and 56B are disposed opposite and parallel to each other. The lower side walls 58A and 58B are similarly arranged with respect to each other. In addition, the filament 18 disposed in the slot 46 comprises coils 64 of a certain pitch in the region where the upper side walls 56A and 56B comprise an arcuate shape, and comprising a greater pitch in the region where the upper side walls define oppositely disposed, parallel walls.

The aforementioned configuration could be utilized, for example, where it desired to enhance the rate of electron emission from one half of the filament 18, while reducing the rate of electron emission from the remaining half. Where such specialized electron emission profiles are desired, analytical methods, such as computer modeling, may be used to determine the optimum shaping of the cathode slot 46 and/or the filament 18. Further, while various exemplary embodiments disclosed herein employ a helical filament, filaments comprising various other geometries may also be employed, consistent with the requirements of a particular application.

Finally, the embodiments of the cathode assembly 16 are but a few examples of a means for emitting electrons according to a predetermined emission profile. Accordingly, it should be understood that the structural configurations disclosed herein are exemplary only and should not be construed as limiting the scope of the invention in any way. In general, any structure(s) capable of implementing the functionality of filament 18 and/or cathode cup 44.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube comprising:

(a) a vacuum enclosure;

(b) a filament and a cathode cup including two walls which cooperate to at least partially define a slot wherein the filament is at least partially disposed, a distance between the filament and the at least one wall varying along at least a portion of the longitudinal length of the filament, and the distance between said filament and at least one of the at least two walls being at a minimum proximate a middle portion of the filament; and (c) an anode positioned within the vacuum enclosure so as receive electrons emitted by the filament.

2. The x-ray tube as recited in claim 1, wherein the distance between the filament and at least one of the at least two walls is at a maximum proximate at least one end portion of the filament.

3. The x-ray tube as recited in claim 1, wherein the at least two walls of the slot are of substantially the same shape and are symmetrically disposed with respect to the filament.

4. An x-ray tube as defined in claim 1, wherein the slot further comprises a bottom surface, and wherein the at least two walls are perpendicularly disposed with respect to the bottom surface.

5. The x-ray tube as recited in claim 1, wherein the slot defines a cross-section having a least two different widths.

6. The x-ray tube as recited in claim 1, wherein the filament is configured such that at least one of the properties of the filament varies along at least a portion of a longitudinal length of the filament, wherein the properties of the filament are selected from the group consisting of: filament wire diameter, pitch, filament diameter.

7. The x-ray tube as recited in claim 1, wherein the slot has a cross sectional area that varies along at least a portion of a length of the slot.

8. The x-ray tube as recited in claim 1, wherein an emission profile associated with the filament is such that a density of emitted electrons per unit area is substantially uniform throughout a predefined plane through which a substantial portion of the emitted electrons pass.

9. The x-ray tube as recited in claim 3, wherein the filament defines a plurality of pitches.

10. The x-ray tube as recited in claim 3, wherein the slot has first and second ends, the slot being wider at the first end than at the second end.

11. The x-ray tube as recited in claim 3, wherein the slot has first and second ends, the slot having substantially the same width at the first and second ends.

12. A cathode assembly suitable for use in an x-ray device, the cathode assembly comprising:

(a) a base portion;

(b) a cathode cup attached to the base portion, the cathode cup including at least two walls which cooperate to at least partially define a slot, wherein the slot defines a cross-section that varies along at least a portion of the length of the slot; and (c) a filament disposed substantially within the slot, the filament taking one of the following forms:

a wire wound into successive coils to form a helix configured such that a diameter of the helix varies along a longitudinal axis defined by the filament, the variances in the diameter of the helix being substantially symmetrically arranged with respect to a predetermined location on the longitudinal axis; and a wire wound into successive coils to form a helix, where a diameter of the wire varies along a longitudinal axis defined by the filament, the variances in the diameter of the wire being substantially symmetrically arranged with respect to a predetermined location on the longitudinal axis.

13. The cathode assembly as recited in claim 12, wherein the predetermined location comprises a location proximate a center of the filament.

14. In an x-ray tube having a filament of predetermined longitudinal length, a method for producing an electron stream having a predetermined electron density profile, the method comprising:

(a) applying a predetermined electric current to the filament so as to cause emission of electrons by the filament;

(b) varying, with respect to the longitudinal length of the filament, the rate at which electrons are emitted by the filament, the varying of the rate at which electrons are emitted by the filament being implemented by performing one of:

varying an electrical field strength in selected areas proximate the filament; and heating the filament in such a way that some portions of the filament are at a relatively higher temperature than other portions of the filament; and (c) accelerating at least some of the emitted electrons toward a focal spot located at a predetermined distance from the filament.

15. A filament, comprising:

(a) a wire wound into successive coils to form a helix, the helix comprising a middle portion and first and second end portions, wherein at least one of a group of properties varies along at least a portion of a longitudinal length of the filament, the group of properties including: wire diameter, wire pitch, and coil diameter; and wherein the wire diameter is greater in the middle portion of the helix than in the first or second end portions; and (b) first and second electrical leads, the first electrical lead being attached to the first end portion of the helix, and the second electrical lead being attached to the second end portion of the helix.

16. The filament as recited in claim 15, wherein the filament comprises an element of a cathode assembly that includes:

a base portion; and a cathode cup attached to the base portion, the cathode cup including two walls which cooperate to at least partially define a slot, the filament being at least partially disposed within the slot.

17. The filament as recited in claim 16, wherein the slot defined by the cathode cup has a cross-section that is substantially constant along a length of the slot.

18. The filament as recited in claim 16, wherein the slot that is defined by the cathode cup has a cross-section that varies along a length of the slot.

* * * * *

UNITED STATES PATENT AND TRADEMARK OFFICE

CERTIFICATE OF CORRECTION

PATENT NO. : 7,327,829 B2
APPLICATION NO. : 10/828637
DATED : February 5, 2008
INVENTOR(S) : Chidester It is certified that error appears in the above-identified patent and that said Letters Patent is hereby corrected as shown below:

Column 5
Line 11, change "FIG. A" to --FIG. 2A--

Column 9
Line 15, change "FIGS. 5A-9" to --FIGS. 4A-9--

Column 10
Line 13, change "middle portion 18A" to --middle portion 18B--

Column 12
Line 42, change "claim 3" to --claim 1--
Line 44, change "claim 3" to --claim 1--
Line 47, change "claim 3" to --claim 1--

Signed and Sealed this

Thirtieth Day of November, 2010

David J. Kappos

David J. Kappos
*Director of the United States Patent and Trademark Office*